US009895032B2

(12) United States Patent
Iannucci

(10) Patent No.: US 9,895,032 B2
(45) Date of Patent: Feb. 20, 2018

(54) ROLL-IN SHOWER AND SHOWER BASE

(71) Applicant: David A. Iannucci, Macomb, MI (US)

(72) Inventor: David A. Iannucci, Macomb, MI (US)

( * ) Notice: Subject to any disclaimer, the term of this patent is extended or adjusted under 35 U.S.C. 154(b) by 230 days.

(21) Appl. No.: 14/705,287

(22) Filed: May 6, 2015

(65) Prior Publication Data

US 2016/0324372 A1 Nov. 10, 2016

(51) Int. Cl.
*A47K 3/40* (2006.01)

(52) U.S. Cl.
CPC ..... *A47K 3/405* (2013.01)

(58) Field of Classification Search
CPC ..... A47K 3/405; A47K 3/40; E06B 3/9632
USPC ..... D34/32; 49/467–471; 14/69.5; 4/612, 4/613; D23/283; D25/48.2, 125
See application file for complete search history.

(56) References Cited

U.S. PATENT DOCUMENTS

| | | | | |
|---|---|---|---|---|
| 3,382,617 A * | 5/1968 | St Aubin | E06B 1/70 | 49/468 |
| 4,541,132 A | 9/1985 | Long | | |
| D345,218 S * | 3/1994 | Haskins | D25/60 | |
| D346,256 S * | 4/1994 | Thomas, III | D34/32 | |
| 5,299,330 A * | 4/1994 | Moore | A47K 3/16 | 4/604 |
| 5,446,937 A * | 9/1995 | Haskins | B65G 69/287 | 14/69.5 |
| 5,901,395 A * | 5/1999 | Vander Heiden | A61G 3/061 | 14/69.5 |
| 6,718,588 B1 * | 4/2004 | Frederiksen | B65G 69/30 | 14/69.5 |
| D502,556 S * | 3/2005 | Zimmerle | D25/138 | |
| 7,007,315 B2 | 3/2006 | Stonecipher | | |
| 7,694,358 B2 | 4/2010 | Stimpson | | |
| D665,513 S * | 8/2012 | Engel | D25/113 | |
| D733,928 S * | 7/2015 | Smith | D25/48.2 | |
| 2014/0259371 A1 | 9/2014 | Schaffer et al. | | |

FOREIGN PATENT DOCUMENTS

DE 3514489 A1 * 10/1986 ..... A47K 3/40

OTHER PUBLICATIONS

U.S. Legal Document, ANSI A117.1 (2009), Standard for Accessible and Usable Buildings and Facilities as mandated by law and incorporated by reference by the States and Municipalities, including Ohio in the Ohio Administrative Code 4401:8-44-01 (162 pages), Chapter 3 Building Blocks, p. 7; Chapter 6 Plumbing Elements and Facilities, p. 58-59.

* cited by examiner

*Primary Examiner* — Erin Deery
(74) *Attorney, Agent, or Firm* — Brooks Kushman P.C.

(57) ABSTRACT

A shower base is provided. The shower base includes a basin that slopes toward a center of the shower base in order to direct water towards a drain. The shower base also includes a curb that extends along a peripheral edge of the basin. The Curb has an elevation that rises above the basin in order to prevent water from spilling out of the basin. An insert is secured to the shower base and is disposed along a threshold between the basin and the curb on an ingress side of the shower base. The insert has a first top surface that slopes down from the curb and towards the basin.

16 Claims, 3 Drawing Sheets

ROLL-IN SHOWER AND SHOWER BASE

TECHNICAL FIELD

The present disclosure relates to roll-in showers and shower bases.

BACKGROUND

Roll-in showers may include a basin that directs water towards a drain. The basin may be surrounded by a curb to prevent water that has collected in the basin from spilling out of the basin and onto the surround area (e.g., bathroom floor). Safety regulations may require that a vertical drop between that basin and the curb does not exceed a predetermined threshold.

SUMMARY

A shower base is provided. The shower base includes a basin that slopes toward a center of the shower base in order to direct water towards a drain. The shower base also includes a curb that extends along a peripheral edge of the basin. The curb has an elevation that rises above the basin in order to prevent water from spilling out of the basin. An insert is secured to the shower base and is disposed along a threshold between the basin and the curb on an ingress side of the shower base. The insert has a first top surface that slopes down from the curb and towards the basin.

An insert for a shower base is provided. The insert consists of an elongate member that has a first top surface, a back surface, and a bottom surface. The first top surface has a downward slope of 1 to 2 or less. The elongate member is configured to mount to an ingress side of the shower base along a threshold between a basin and a curb of the shower base. The bottom surface of the insert is configured to cooperate with the basin and the back surface of the insert is configured to cooperate with the curb when the elongate member is mounted to the shower base.

A roll-in shower is provided. The roll-in shower includes a base that has a basin and a curb. The basin is configured to direct water towards a drain. The curb extends along a peripheral edge of the basin at an elevation that rises above the basin in order to prevent water from spilling out of the basin. An insert is secured to an ingress side of the shower along a threshold between the basin and the curb. The insert has a first top surface that has a downward slope of 1 to 2 or less.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
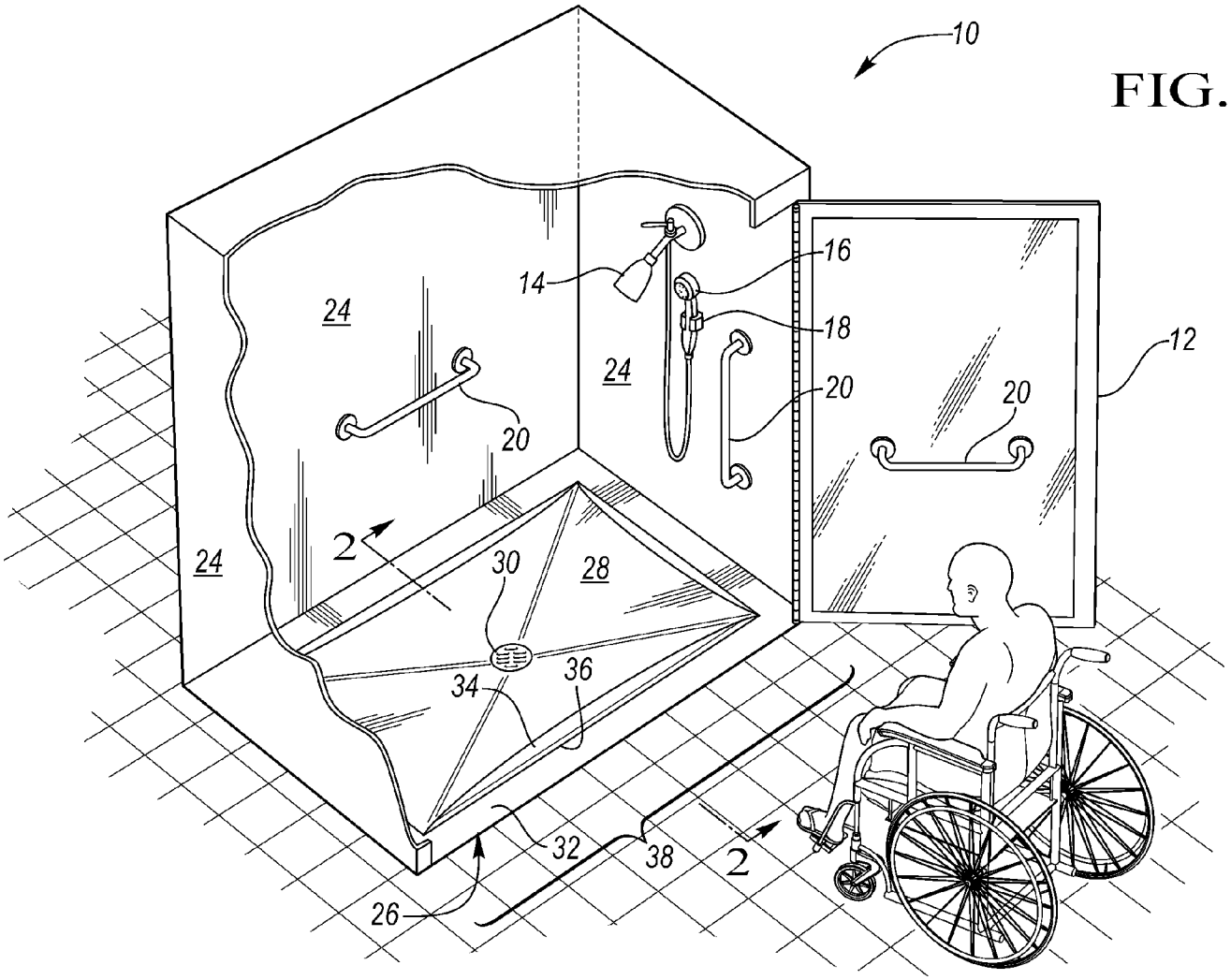
FIG. 1 is a cut away isometric view of a roll-in shower.

Referring to FIG. 1, a roll-in shower 10 is illustrated. The roll-in shower 10 may be adapted for use by elderly or handicapped persons, including individuals that require the use of a wheelchair. The roll-in shower 10 may include a door 12, shower head 14, hand shower 16, holster 18 for the hand shower 16, handles 20, seat, outer walls 24, and shower base 26. The holster 18 may be mounted to any of the outer walls 24. The seat may be also attached to any of the outer walls 24, and may be retractable from a horizontal to a vertical position. The base 26 may include a basin 28 that is configured to direct water towards a drain 30. The base 26 may also include a curb 32 that extends along a peripheral edge of the basin 28. The curb 32 may have an elevation that rises above the elevation of the basin 28 in order to prevent water from spilling out of the basin 28. The basin 28 and the curb 32 are shown as separate components; however they may be combined into one single component that performs both the function of the basin 28 and the curb 32. Filler material 33, such as a structural foam, cement, or concrete may be disposed between the basin 28 and a subfloor. An insert 34, that may consist of an elongate member, may be secured to the shower base 26 along a threshold 36 between the basin 28 and the curb 32. The insert 34 may be located along an ingress/egress side 38 of the roll-in shower 10 or shower base 26.

Figure 2:
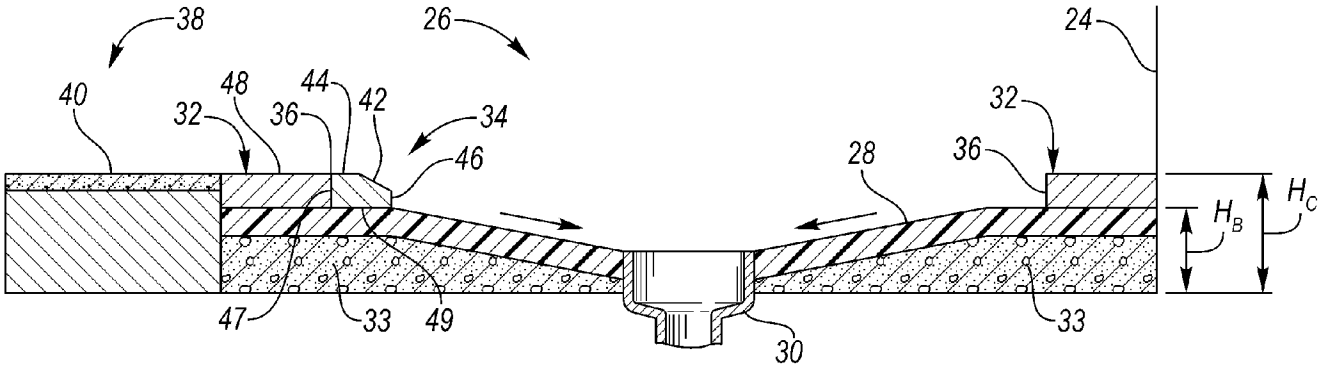
FIG. 2 is a cross-sectional view of a shower base taken along line 2-2 in FIG. 1.

Referring to FIG. 2, a cross-sectional view of the shower base 26 taken along the line 2-2 in FIG. 1 is illustrated. The basin 28 may have a portion that slopes towards the drain 30 in order to direct water to the drain 30. The elevation of the curb $H_c$ is shown to have an elevation that exceeds the elevation of the basin $H_b$, in order prevent water from spilling out of the basin 28 and onto the adjacent floor 40. The insert 34 may include a first top surface 42 that slopes down and away from the curb 32 and towards the basin 28. The insert 34 may additionally include a second top surface 44, a vertical surface 46, a back surface 47, and a bottom surface 49. The back surface 47 may be configured to cooperate with the curb 32 and the bottom surface 49 may be configured to cooperate with the basin 28 when the insert 34 is secured to the shower base 26. The second top surface 44 may be located adjacent to a first side of the first top surface 42 while the vertical surface 46 may be located adjacent to a second side of the first top surface 42. The second top surface 44 may also be located between the first top surface 42 and a top surface 48 of the curb 32. The second top surface 44 may be flush with the top surface 48 of the curb 32. The second top surface 44 and the top surface 48 of the curb 32 may also be horizontally oriented.

Figure 4A:
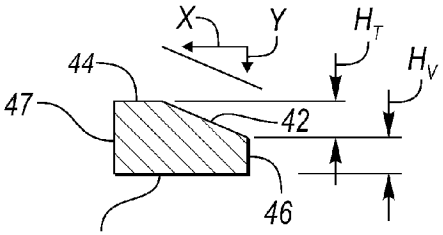
FIG. 4A is a cross-sectional view of the first embodiment of the inert taken along line 4A-4A in FIG. 3.
Figure 3:
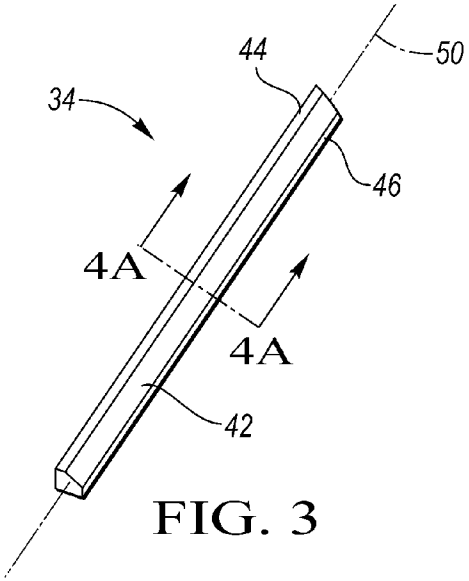
FIG. 3, is an isometric view of a first embodiment of an insert for the shower base.
Figure 6:
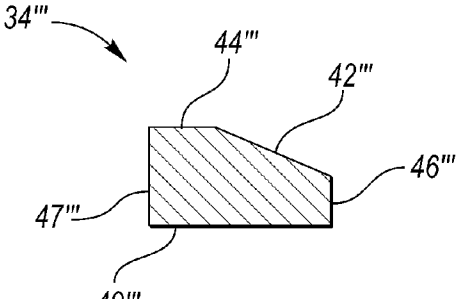
FIG. 6 is a cross-sectional view of the fourth embodiment of the insert taken along line 6-6 in FIG. 5.
Figure 7:
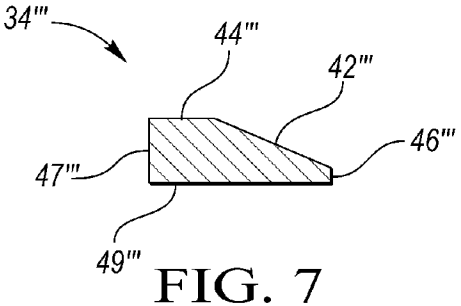
FIG. 7 is a cross-sectional view of the fourth embodiment of the insert taken along line 7-7 in FIG. 5.
Figure 8:
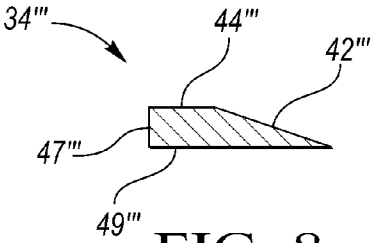
FIG. 8 is a cross-sectional view of the fourth embodiment of the insert taken along line 8-8 in FIG. 5.
Figure 5:
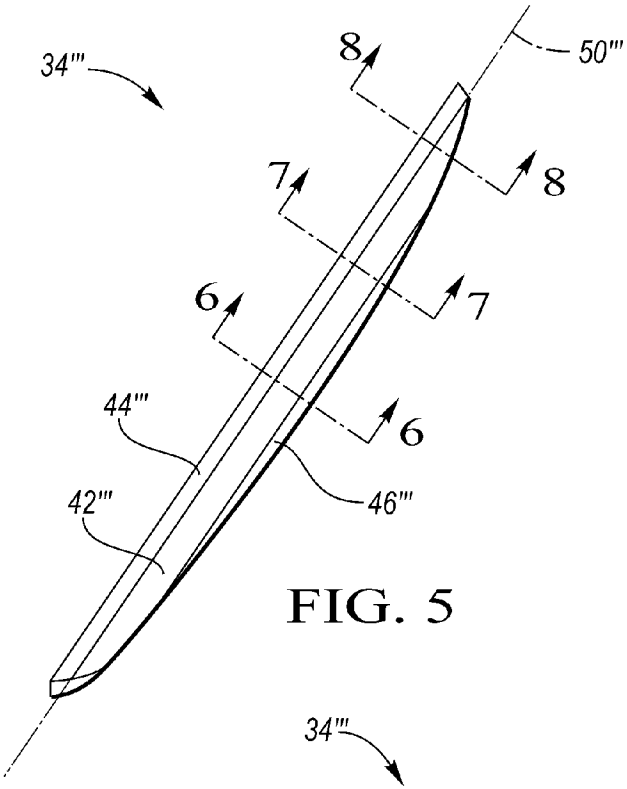
FIG. 5 is an isometric view of a fourth embodiment of the insert.
Figure 9:
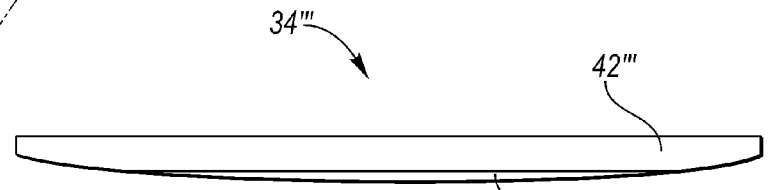
FIG. 9 is front view of the fourth embodiment of the insert.

Referring to FIGS. 3 and 4A, a first embodiment of the insert 34 is illustrated. The first embodiment of the insert 34 has a constant cross-sectional shape along a longitudinal axis 50. The first embodiment includes the first top surface 42, second top surface 44, vertical surface 46, back surface 47, and bottom surface 49 described above. The first top surface 42 is shown to have a downward slope of y/x. The downward slope may have a ratio of y to x that has a value of 1 to 2 or less (i.e., the downward slope may have a limit where the slope is not steeper than 1:2). The vertical surface 46 may have a height $H_v$ of ¼ of an inch or less. The sum of the height $H_v$ of the vertical surface 46 with the vertical displacement $H_T$ of the first top surface 42 may have a value of ½ of an inch or less.

Figure 4C:
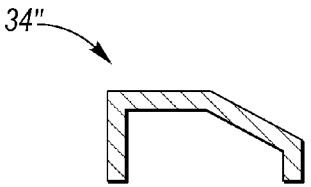
FIG. 4C is a cross-sectional view of a third embodiment of the insert.
Figure 4B:
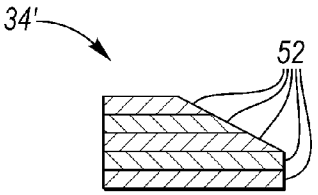
FIG. 4B is a cross-sectional view of a second embodiment of the insert.

Referring to FIG. 4B, a cross-sectional view of a second embodiment of the insert 34' is illustrated. The second embodiment of the insert 34' may have the same general overall shape and characteristics as the first embodiment of the insert 34 depicted in FIGS. 3 and 4A. The second embodiment of the insert 34', however, differs from the first embodiment in that the second embodiment of the insert 34' is comprised of a series of vertically stacked shims 52.

Referring to FIG. 4C, a cross-sectional view of a third embodiment of the insert 34" is illustrated. The third embodiment of the insert 34" may have the same general overall shape and characteristics as the first embodiment of the insert 34 depicted in FIGS. 3 and 4A. The third embodiment of the insert 34", however, differs from the first embodiment in that material has been removed from a bottom side of the third embodiment of the insert 34". It may be advantageous to remove material from nonessential or nonfunctional portions of the insert 34" to save on material costs, as long as removing the material does not compromise the structural integrity of the insert 34". Alternatively, material may be removed from other nonessential or nonfunctional portions of the insert 34" to save on material costs. For example material may be only removed from the center of the insert 34", such that the insert 34" forms a hollow member.

Referring to FIGS. 5-9, a fourth embodiment of the insert 34''' is illustrated. The fourth embodiment of the insert 34''' may also include a first top surface 42", a second top surface 44", a vertical surface 46", a back surface 47', and a bottom surface 49'''. The back surface 47''' may be configured to cooperate with the curb 32 and the bottom surface 49''' may be configured to cooperate with the basin 28 when the insert 34''' is secured to the shower base 26. The first top surface 42", second top surface 44", vertical surface 46", back surface 47', and bottom surface 49''' may function in the same manner and have the same characteristics as the first top surface 42, second top surface 44, vertical surface 46, back surface 47, and bottom surface 49 of the first embodiment of the insert 34, as described above. A cross-section of the fourth embodiment of the insert 34''' tapers along a longitudinal axis 50''' in both directions moving away from a center of the fourth embodiment of the insert 34'''.

The vertical displacement between the curb 32 and basin 28 along threshold 36 may vary depending on the location. The fourth embodiment of the insert 34''' is an example of an alternative embodiment that is meant to conform to the contour of a non-constant threshold 36 between the curb 32 and the basin 28. The fourth embodiment of the insert 34''' conforms to the contour of a non-constant threshold 36 where the vertical displacement between the curb 32 and basin 28 is deeper towards the center of the ingress/egress side 38 of the shower base 26 and shallower towards the ends of the ingress/egress side 38 of the shower base 26. It should be understood that the fourth embodiment of the insert 34''' may be adapted to conform to the contour of any threshold 36 between the curb 32 and the basin 28, and should not be limited to the description of the fourth embodiment of the insert 34'''. For example, the vertical displacement between the curb 32 and basin 28 along threshold 36 may gradually increase or decrease from one end of the ingress/egress side 38 to the other end of the ingress/egress side 38.

The inserts 34, 34', 34", and 34''' described above may be attached to the shower base 26 by any conventional means. For example the inserts 34, 34', 34", and 34''' may be attached via fasteners that extend through the inserts and into the shower base 26. Alternatively, the inserts 34, 34', 34", and 34''' may be attached via an adhesive.

It should be understood that the components in alternative embodiments that have like identifies or call-out numbers, whether one or more prime symbols (') are included or not included, should be construed as having the same characteristics as the like numbers in the other embodiments unless otherwise indicated.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A shower base comprising:

a basin sloping toward a center of the shower base, configured to direct water towards a drain;

a curb extending along a peripheral edge of the basin and having an elevation that rises above the basin; and an insert, secured to the shower base, disposed along a threshold at the junction between the basin and the curb on an ingress side of the shower base, the insert having a first top surface and a cross-section, wherein the top surface slopes down from the curb and towards the basin and the cross-section continuously tapers outward from a center point of the insert along a longitudinal axis such that a height of the insert continuously decreases extending outward from the center point of the of the insert toward each end of the insert.

2. The shower base of claim 1, wherein the insert has a second top surface adjacent to a first side of the first top surface, and wherein the second top surface located between the first top surface and a top surface of the curb.

3. The shower base of claim 2, wherein the second top surface is flush with the top surface of the curb.

4. The shower base of claim 3, wherein the second top surface and the top surface of the curb are horizontally oriented.

5. The shower base of claim 2, wherein the insert has a vertical surface adjacent to a second side of the first top surface.

6. The shower base of claim 5, wherein the first top surface has a downward slope of 1 to 2 or less.

7. The shower base of claim 6, wherein the vertical surface does not exceed a height of ¼ of an inch.

8. The shower base of claim 7, wherein the sum of a vertical displacement of the first top surface and the height of the vertical surface does not exceed ½ of an inch.

9. An insert for a shower base comprising:

an elongate member having a first top surface, a back surface, a bottom surface, and a cross-section, the first top surface having a downward slope of 1 to 2 or less, wherein the cross-section continuously tapers outward from a center point of the insert along a longitudinal axis such that a height of the insert continuously decreases extending outward from the center point of the of the insert toward each end of the insert, and wherein the elongate member is configured to mount to an ingress side of the shower base along a threshold between a basin and a curb of the shower base, and wherein the bottom surface is configured to cooperate with the basin and the back surface is configured to cooperate with the curb when the elongate member is mounted to the shower base.

10. The insert of claim 9, wherein the elongate member has a second top surface adjacent to a first side of the first top surface, and wherein the second top surface is flush with a top surface of the curb when the elongate member is mounted to the shower base.

11. The insert of claim 10, wherein the second top surface and the top surface of the curb are horizontally oriented when the elongate member is mounted to the shower base.

12. The insert of claim 10, wherein the elongate member has a vertical surface adjacent to a second side of the first top surface.

13. The insert of claim 12, wherein the vertical surface does not exceed a height of ¼ on an inch.

14. The insert of claim 13, wherein the sum of a vertical displacement of the first top surface and the height of the vertical surface does not exceed ½ of an inch.

15. A roll-in shower comprising:

a base having a basin and a curb, wherein the basin is configured to direct water towards a drain and the curb extends along a peripheral edge of the basin at an elevation rising above the basin; and an insert having a cross-section and a first top surface that has a downward slope of 1 to 2 or less, wherein the cross-section continuously tapers outward from a center point of the insert along a longitudinal axis such that a height of the insert continuously decreases extending outward from the center point of the of the insert toward each end of the insert, and wherein the insert is secured to an ingress side of the shower along a threshold between the basin and the curb.

16. The roll-in shower of claim 15, wherein the insert has a second top surface adjacent to a first side of the first top surface and a vertical surface adjacent to a second side of the first top surface, wherein the second top is surface located between the first top surface and a top surface of the curb and the second top surface is flush with the top surface of the curb.

* * * * *